US009052645B2

(12) United States Patent
Wu

(10) Patent No.: US 9,052,645 B2
(45) Date of Patent: Jun. 9, 2015

(54) POLYARYLATECARBONATE INTERMEDIATE TRANSFER MEMBERS

(71) Applicant: Xerox Corporation, Norwalk, CT (US)

(72) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 259 days.

(21) Appl. No.: 13/862,402

(22) Filed: Apr. 13, 2013

(65) Prior Publication Data

US 2014/0306163 A1 Oct. 16, 2014

(51) Int. Cl.

| | |
|---|---|
| ***G03G 15/14*** | (2006.01) |
| ***H01B 1/24*** | (2006.01) |
| ***G03G 15/16*** | (2006.01) |
| ***H01B 1/06*** | (2006.01) |
| *H01C 7/02* | (2006.01) |

(52) U.S. Cl.

CPC ..... *G03G 15/162* (2013.01); *H01B 1/24* (2013.01); *G03G 15/1605* (2013.01); *H01C 7/027* (2013.01); *H01B 1/06* (2013.01)

(58) Field of Classification Search

None

See application file for complete search history.

(56) References Cited

U.S. PATENT DOCUMENTS

| | | | | |
|---|---|---|---|---|
| 5,130,215 | A * | 7/1992 | Adley et al. | 430/58.4 |
| 5,487,707 | A | 1/1996 | Sharf et al. | |
| 6,139,784 | A | 10/2000 | Oshima et al. | |
| 6,318,223 | B1 | 11/2001 | Yu et al. | |
| 6,397,034 | B1 | 5/2002 | Tarnawskyj et al. | |
| 6,440,515 | B1 | 8/2002 | Thornton et al. | |
| 6,602,156 | B2 | 8/2003 | Schlueter, Jr. | |
| 7,031,647 | B2 | 4/2006 | Mishra et al. | |
| 7,130,569 | B2 | 10/2006 | Goodman et al. | |
| 7,139,519 | B2 | 11/2006 | Darcy, III et al. | |
| 2002/0076515 | A1 * | 6/2002 | Maeyama et al. | 428/35.8 |
| 2007/0253740 | A1 * | 11/2007 | Kagawa et al. | 399/176 |

* cited by examiner

*Primary Examiner* — Harold Pyon
*Assistant Examiner* — Katie L Hammer
(74) *Attorney, Agent, or Firm* — Eugene O. Palazzo

(57) ABSTRACT

An intermediate transfer member that includes polyarylatecarbonate, an optional polysiloxane, and an optional conductive filler component.

18 Claims, 1 Drawing Sheet

POLYARYLATECARBONATE INTERMEDIATE TRANSFER MEMBERS

CROSS-REFERENCE TO COPENDING APPLICATION

Disclosed in now U.S. Pat. No. 8,785,091, and the disclosure of which is totally incorporated herein by reference, is a photoconductor comprising a charge transport layer containing a polyarylatecarbonate.

This disclosure is generally directed to an intermediate transfer member comprised of a polyarylatecarbonate, an optional polysiloxane, and an optional conductive component.

BACKGROUND

Intermediate transfer members, such as intermediate transfer belts selected for transferring a developed image in xerographic systems, are known. For example, there are known a number of intermediate transfer members that include materials of a low unacceptable modulus or break strength, poor release characteristics from metal substrates, or which members are costly to prepare primarily because of the cost or scarcity of raw materials and lengthy drying times. Also known are various intermediate transfer members with characteristics that cause these members to become brittle resulting in inadequate acceptance of the developed image, and subsequent partial transfer of developed xerographic images to a substrate like paper.

A disadvantage relating to the preparation of an intermediate transfer member is that there is usually deposited a separate release layer on a metal substrate, and thereafter, there is applied to the release layer the intermediate transfer member components, and where the release layer allows the resultant intermediate transfer member to be separated from the metal substrate by peeling or by the use of mechanical devices. Thereafter, the intermediate transfer member is in the form of a film, which can be selected for xerographic imaging systems, or the film can be deposited on a supporting substrate like a polymer layer. The use of a release layer adds to the cost and time of preparation, and such a layer can modify a number of the intermediate transfer member characteristics.

For low end xerographic machines and printers that produce about 30 pages or less per minute, thermoplastic intermediate transfer members are usually used because of their low cost. However, the modulus values of thermoplastic materials, such as certain polycarbonates, polyesters, and polyamides, can be relatively low of, for example, from about 1,000 to 1,500 Mega Pascals (MPa).

High end xerographic machines and printers that generate at least about 30 pages per minute, and up to about 75 pages per minute, or more usually utilize intermediate transfer members of thermoplastic polyimides, thermosetting polyimides, or polyamideimides, primarily because of their high modulus of about 3,500 MPa or more. However, intermediate transfer members using these materials are more expensive in that both the raw material cost and the manufacturing process cost are higher when using thermoplastic or thermoset polyimides or polyamideimides. Thus, an economical intermediate transfer member possessing high modulus and excellent release characteristics for high end machines is desired.

There is a need for intermediate transfer members that substantially avoid or minimize the disadvantages of a number of known intermediate transfer members.

Also, there is a need for intermediate transfer members with excellent break strengths as determined by their modulus measurements, which are readily releasable from substrates, possess high glass transition temperatures, such as greater than about 150° C. like from about 160 to about 400° C., and from about 170 to about 350° C., and which members possess improved stability with no or minimal degradation for extended time periods.

Moreover, there is a need for intermediate transfer member materials that possess rapid release characteristics from a number of substrates that are selected when such members are prepared.

Yet another need resides in providing intermediate transfer members that comprise economical substantially soluble polymer binders, that are of high modulus, easily releaseable from metal substrates, and which members can be generated by flow coating processes.

Another need relates to providing seamless intermediate transfer members that have excellent conductivity or resistivity, and that possess acceptable humidity insensitivity characteristics leading to developed images with minimal resolution issues.

Further, there is a need for seamless intermediate transfer members containing components that can be economically and efficiently manufactured.

These and other needs are achievable in embodiments with the intermediate transfer members and components thereof disclosed herein.

SUMMARY

Disclosed herein is an intermediate transfer member comprising a polyarylatecarbonate.

Further disclosed herein is an intermediate transfer member comprised of a supporting substrate, and thereover a layer comprised of a mixture of a polyarylatecarbonate, a conductive component, and a polysiloxane wherein the polyarylatecarbonate is selected from the group consisting of those represented by the following formulas/structures

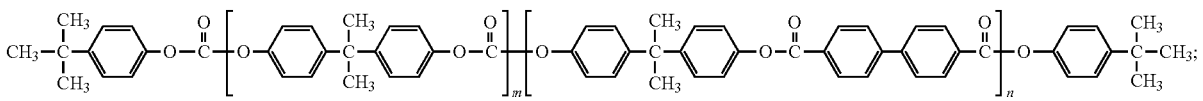

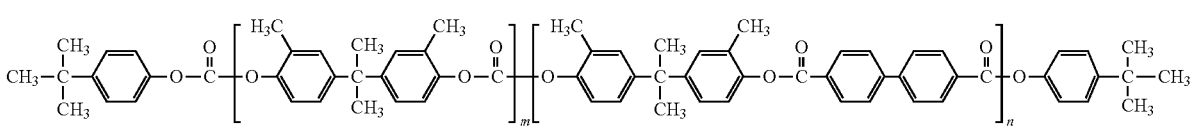

and

-continued

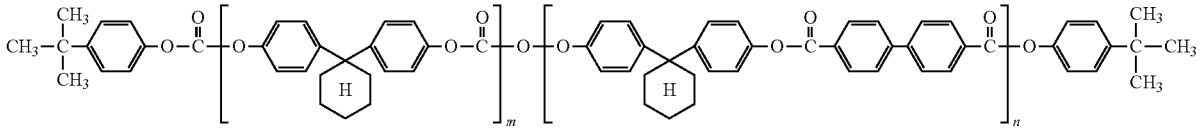

and mixtures thereof, wherein m is from about 60 to about 90 mol percent; n is from about 10 to about 40 mol percent, and wherein the total thereof is about 100 mol percent.

Yet additionally disclosed herein is an intermediate transfer member comprised of said member and a photoconductor, and where a developed toner image is transferred from the photoconductor to the intermediate transfer member, and which member is comprised of an optional supporting substrate, and thereover a layer mixture of carbon black, a polysiloxane, and a polyarylatecarbonate of

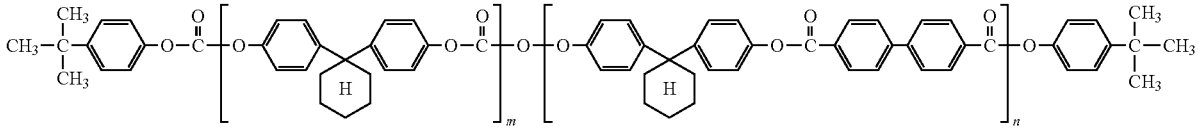

wherein m is from about 75 to about 85 mol percent, and n is from about 15 to about 25 mol percent.

FIGURES

The following Figures are provided to further illustrate the intermediate transfer members disclosed herein.

EMBODIMENTS

There is provided herein an intermediate transfer member comprising a polyarylatecarbonate that enables or assists in enabling efficient release from a substrate, such as stainless steel, thereby avoiding the need for a separate release layer on the substrate.

More particularly, there is provided herein a seamless intermediate transfer member comprising a mixture in the configuration of a polymer layer, of a polyarylatecarbonate, a filler or conductive component, and a polysiloxane.

Also, there is illustrated herein a seamless intermediate transfer member comprising a mixture of a polyarylatecarbonate copolymer, a polycarbonate, a polysiloxane, and a conductive filler component, and including an optional release layer.

Figure 1:
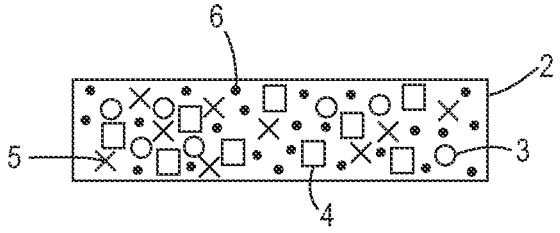
FIG. 1 illustrates an exemplary embodiment of a one-layer intermediate transfer member of the present disclosure.

In FIG. 1 there is illustrated an intermediate transfer member comprising a layer 2 comprised of a polyarylatecarbonate 3, or a mixture of a polyarylatecarbonate 3, and as optional ingredients an optional polycarbonate 4, an optional siloxane polymer 5, and an optional conductive component 6.

Figure 2:
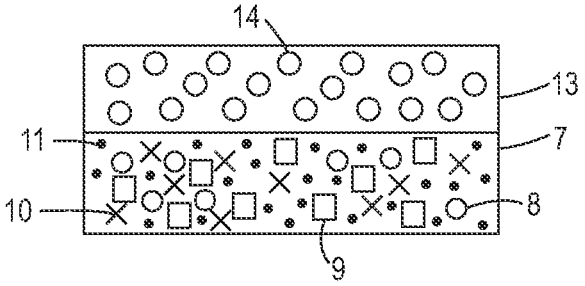
FIG. 2 illustrates an exemplary embodiment of a two-layer intermediate transfer member of the present disclosure.

In FIG. 2 there is illustrated a two-layer intermediate transfer member comprising a bottom layer 7 comprising a polyarylatecarbonate 8, or a mixture of a polyarylatecarbonate 8, such as a copolymer thereof of a polyarylatecarbonate 8, and an optional polycarbonate 9, an optional siloxane polymer 10, and an optional conductive component 11, and an optional top or outer toner release layer 13, comprising release components 14.

Figure 3:
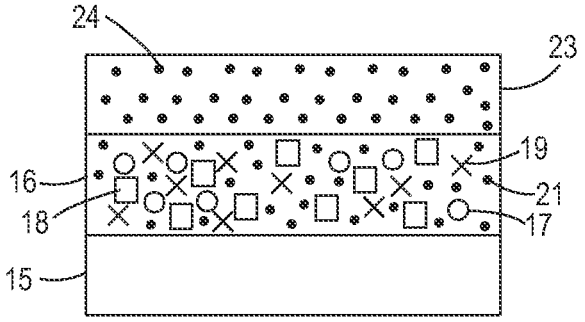
FIG. 3 illustrates an exemplary embodiment of a three-layer intermediate transfer member of the present disclosure.

In FIG. 3 there is illustrated a three-layer intermediate transfer member comprising a supporting substrate 15, a layer thereover 16 comprising a polyarylatecarbonate 17, or a mixture of a polyarylatecarbonate 17 and a polycarbonate 18, an optional siloxane polymer 19, and an optional conductive component 21, and an optional release layer 23 comprising release components 24.

The intermediate transfer members disclosed herein exhibit excellent release characteristics (self-release), and where the use of an external release layer present on, for example, a stainless steel substrate is avoided; have excellent mechanical strength while permitting the rapid and complete transfer, such as from about 90 to about 99 percent, or from about 95 to about 100 percent transfer of a xerographic developed image; possess a Young's modulus of, for example, from about 2,500 to about 3,500, from about 2,600 to about 5,000 Mega Pascals (MPa), from about 2,400 to about 3,000, from about 2,600 to about 3,200, from about 3,000 to about 7,000 Mega Pascals (MPa), from about 3,000 to about 5,500 MPa, from about 3,600 to about 6,000 MPa, from about 3,500 to about 5,000 MPa, from about 3,000 to about 5,000 MPa, from about 4,800 to about 5,000 MPa, or from about 3,700 to about 4,000 MPa; a high glass transition temperature (Tg) of, for example, from about 150 to about 400° C., from about 160 to about 375° C., from about 160 to about 400° C., from about 170 to about 350° C., or from about 180 to about 350° C.; a CTE (coefficient of thermal expansion) of, for example, from about 40 to about 100 ppm/° K (parts per million per degree Kelvin), from about 50 to about 90 ppm/° K or from about 85 to about 90 ppm/° K; and an excellent resistivity as measured with a known High Resistivity Meter of, for example, from about $10^8$ to about $10^{13}$ ohm/square, from about $10^9$ to about $10^{13}$ ohm/square, from about $10^9$ to about $10^{12}$ ohm/square, or from about $10^{10}$ to about $10^{12}$ ohm/square. The resistivity of the disclosed intermediate transfer members can be adjusted by varying the concentration of the conductive particles.

Self-release characteristics without the assistance of any external sources, such as prying devices, permit the efficient, economical formation, and full separation, such as from about 95 to about 100 percent, or from about 97 to about 99 percent separation of the disclosed intermediate transfer members from substrates, such as steel, aluminum, or glass, upon which the members are initially prepared in the form of a film. Self-release also avoids the need for release materials and separate release layers on the metal substrates. The time period to obtain the self-release characteristics varies depending, for example, on the selected various polyarylatecarbonates disclosed herein. Generally, however, this time period is from about 1 to about 60 seconds, such as from about 1 to about 35 seconds, from about 1 to about 15 seconds, from about 1 to about 10 seconds, or from 1 to about 5 seconds, and in some instances less than about 1 second.

The intermediate transfer members of the present disclosure can be provided in any of a variety of configurations, such as a one-layer configuration, or in a multi-layer configuration, including, for example, a top release layer. More specifically, the final intermediate transfer member may be in the form of an endless flexible belt, a web, a flexible drum or roller, a rigid roller or cylinder, a sheet, a drelt (a cross between a drum and a belt), an endless seamed flexible belt, a seamless belt (that is with an absence of any seams or visible joints in the members), and the like.

Polyarylatecarbonates

Various polyarylatecarbonates can be selected for inclusion in the intermediate transfer members of the present disclosure. Examples of polyarylatecarbonates selected for the disclosed intermediate transfer members, and which polyarylatecarbonates are available from Mitsubishi Gas Chemical Company, Inc., are represented by the following formulas/structures and mixtures thereof Mole percent, or molar percent, refers in embodiments of the present disclosure to the ratio of the moles of the specific monomer segment to the total moles of the monomers in the polymer.

Specific examples of polyarylatecarbonate copolymers available from Mitsubishi Gas Chemical Company, Inc., and comprising a biphenyl moiety are represented by the following formulas/structures, and mixtures thereof, wherein m is from about 75 to about 85 mol percent and n is from about 15 to about 25 mol percent, or wherein m is from about 75 to about 80 mol percent and n is from about 20 to about 25 mol percent, and the mol percents total about 100 mol percent; and yet more specifically wherein m and n are as illustrated below, and wherein the viscosity average molecular weight ($M_v$) and which viscosity average molecular weights, as determined by known methods are as provided by Mitsubishi Gas Chemical Company, Inc.

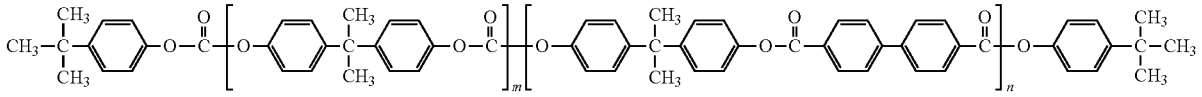

PAC-A80BP20

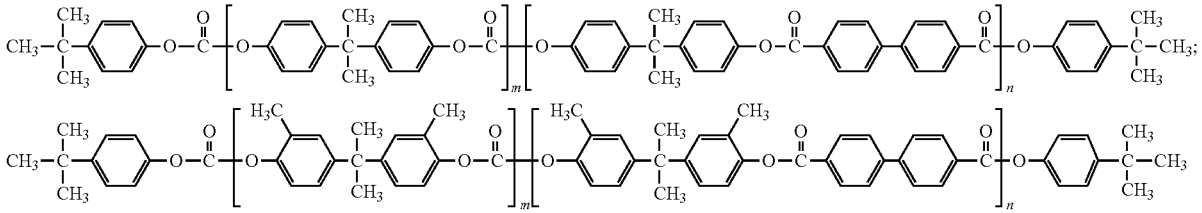

and

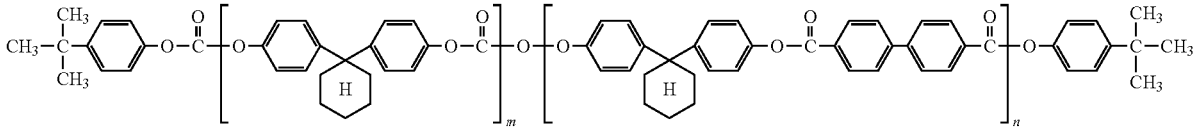

wherein m and n are the mol percents of each segment, respectively, as measured by known methods, and more specifically by NMR, with m being, for example, from about 60 to about 90 mol percent, from about 60 to about 95 mol percent, from about from about 70 to about 90 mol percent, from about 75 to about 85 mol percent or from about 65 to about 85 mol percent; n being, for example, from about 5 to about 40 mol percent, from about 10 to about 40 mol percent, from about 15 to about 35 mol percent, from about 15 to about 25 mol percent or from about 15 to about 20 mol percent with the total of m and n being equal to about 100 mol percent.

wherein m is from about 75 to about 85 mole percent, and n is from about 15 to about 25 mol percent, with the total of m and n being equal to about 100 mol percent, and more specifically, where m is equal to about 80 mol percent and n is equal to about 20 mol percent, with the total of m and n being equal to about 100 mol percent, and with the viscosity average molecular weight being equal to about 57,200.

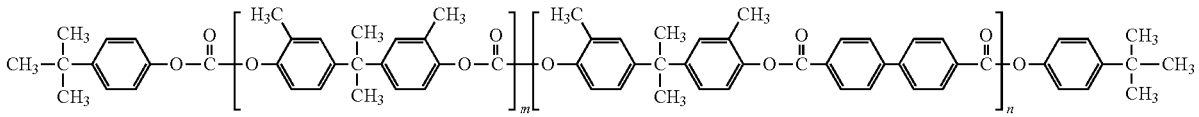

PAC-C80BP20 wherein m is from about 75 to about 85 mole percent and n is from about 15 to about 25 mol percent, with the total of m and n being equal to about 100 percent, or wherein m is from about 65 to about 85 mol percent, n is from about 15 to about 35 mol percent with the total of m and n being equal to about 100 mol percent, and more specifically, where m is equal to about 80 mol percent and n is equal to about 20 mol percent, with the total of m and n being equal to about 100 mol percent, and with a viscosity average molecular weight of about 62,600.

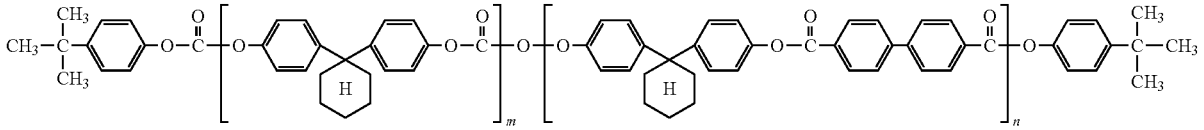

PAC-Z80BP20 wherein m is from about 75 to about 85 mole percent and n is from about 15 to about 25 mol percent with the total of m and n being equal to about 100 mol percent, and more specifically, where m equals about 80 mol percent, n equals about 20 mol percent, with the total of m and n being equal to about 100 mol percent, and with a viscosity average molecular weight of about 46,600.

The polyarylatecarbonates illustrated herein can be present in the intermediate transfer members in a number of effective amounts, such as for example, in an amount of from about 50 to about 90 weight percent, from about 70 to about 90 weight percent, from about 70 to about 85 weight percent, from about 40 to about 85 weight percent, from about 65 to about 95 weight percent, from about 60 to about 95 weight percent, from about 80 to about 90 weight percent, from about 45 to about 80 weight percent, from about 50 to about 75 weight percent, from about 50 to about 70 weight percent, from about 75 to about 85 weight percent, or yet more specifically about 80 weight percent based on the total solids or based on the total of components or ingredients present.

The polyarylatecarbonates, such as the copolymers thereof, possess, for example, a weight average molecular weight of from about 40,000 to about 70,000 or from about 50,000 to about 60,000 as determined by GPC analysis, and a number average molecular weight of from about 30,000 to about 60,000 or from about 40,000 to about 50,000 as determined by GPC analysis.

The mixtures of the polyarylatecarbonates, conductive fillers, and polysiloxanes are present in the amounts and ratios indicated herein. Exemplary weight percent ratios include about 90/9.99/0.01, about 95/4/1, about 91/8/1, about 90/9.95/0.05, about 90/9.9/0.1, about 89.99/10/0.01, about 85/14.5/0.5, about 80/19.95/0.05, about 80/19.8/0.2, about 85/12/3, about 85/14.95/0.05 and other suitable weight percent ratios.

Polysiloxane Polymers

The intermediate transfer member can also generally comprise a polysiloxane polymer. Examples of polysiloxane polymers selected for the intermediate transfer members disclosed herein include known suitable polysiloxanes, such as a copolymer of a polyether and a polydimethylsiloxane, commercially available from BYK Chemical as BYK® 333, BYK® 330 (about 51 weight percent in methoxypropylacetate), and BYK® 344 (about 52.3 weight percent in xylene/isobutanol, ratio of 80/20); BYK®-SILCLEAN 3710 and BYK® 3720 (about 25 weight percent in methoxypropanol); a copolymer of a polyester and a polydimethylsiloxane, commercially available from BYK Chemical as BYK® 310 (about 25 weight percent in xylene), and BYK® 370 (about 25 weight percent in xylene/alkylbenzenes/cyclohexanone/monophenylglycol, ratio of 75/11/7/7); a copolymer of a polyacrylate and a polydimethylsiloxane, commercially available from BYK Chemical as BYK®-SILCLEAN 3700 (about 25 weight percent in methoxypropylacetate); a copolymer of polyester polyether and a polydimethylsiloxane, commercially available from BYK Chemical as BYK® 375 (about 25 weight percent in di-propylene glycol monomethyl ether); and the like, and mixtures thereof.

The polysiloxane polymer, or copolymers thereof can be included in the about 10 weight percent, from about 0.01 to about 1 weight percent, from about 0.05 to about 1 weight percent, from about 0.05 to about 0.5 weight percent, from about 0.1 to about 0.5 weight percent, from about 0.2 to about 0.5 weight percent, or from about 0.1 to about 0.3 weight percent based on the total weight of the components or ingredients present.

Optional Fillers

Optionally, the intermediate transfer member may contain one or more fillers to, for example, alter and adjust the conductivity of the intermediate transfer member. Where the intermediate transfer member is a one layer structure, the conductive filler can be included in the mixture of the polyarylatecarbonate polycarbonate disclosed herein. However, where the intermediate transfer member is a multi-layer structure, the conductive filler can be included in one or more layers of the member, such as in the supporting substrate, the polymer layer, or mixtures thereof coated thereon, or in both the supporting substrate and the polymer layer.

Any suitable filler can be used that provides the desired results. For example, suitable fillers include carbon blacks, metal oxides, polyanilines, graphite, acetylene black, fluorinated carbon blacks, other known suitable fillers, and mixtures of fillers.

Examples of carbon black fillers that can be selected for the intermediate transfer members illustrated herein include special black 4 (B.E.T. surface area=180 $m^2/g$, DBP absorption=1.8 ml/g, primary particle diameter=25 nanometers) available from Evonik-Degussa, special black 5 (B.E.T. surface area=240 $m^2/g$, DBP absorption=1.41 ml/g, primary particle diameter=20 nanometers), color black FW1 (B.E.T. surface area=320 $m^2/g$, DBP absorption=2.89 ml/g, primary particle diameter=13 nanometers), color black FW2 (B.E.T. surface area=460 $m^2/g$, DBP absorption=4.82 ml/g, primary particle diameter=13 nanometers), color black FW200 (B.E.T. surface area=460 $m^2/g$, DBP absorption=4.6 ml/g, primary particle diameter=13 nanometers), all available from Evonik-Degussa; VULCAN® carbon blacks, REGAL® carbon blacks, MONARCH® carbon blacks, and BLACK PEARLS® carbon blacks available from Cabot Corporation. Specific examples of conductive carbon blacks are BLACK PEARLS® 1000 (B.E.T. surface area=343 $m^2/g$, DBP absorption=1.05 ml/g), BLACK PEARLS® 880 (B.E.T. surface area=240 $m^2/g$, DBP absorption=1.06 ml/g), BLACK PEARLS® 800 (B.E.T. surface area=230 $m^2/g$, DBP absorption=0.68 ml/g), BLACK PEARLS® L (B.E.T. surface area=138 $m^2/g$, DBP absorption=0.61 ml/g), BLACK PEARLS® 570 (B.E.T. surface area=110 $m^2/g$, DBP absorption=1.14 ml/g), BLACK PEARLS® 170 (B.E.T. surface area=35 $m^2/g$, DBP absorption=1.22 ml/g), VULCAN® XC72 (B.E.T. surface area=254 $m^2/g$, DBP absorption=1.76 ml/g), VULCAN® XC72R (fluffy form of VULCAN® XC72), VULCAN® XC605, VULCAN® XC305, REGAL® 660 (B.E.T. surface area=112 $m^2/g$, DBP absorption=0.59 ml/g), REGAL 400 (B.E.T. surface area=96 $m^2/g$, DBP absorption=0.69 ml/g), REGAL® 330 (B.E.T. surface area=94 $m^2/g$, DBP absorption=0.71 ml/g), MONARCH® 880 (B.E.T. surface area=220 $m^2/g$, DBP absorption=1.05 ml/g, primary particle diameter=16 nanometers), and MONARCH® 1000 (B.E.T. surface area=343 $m^2/g$, DBP absorption=1.05 ml/g, primary particle diameter=16 nanometers); and Channel carbon blacks available from Evonik-Degussa. Other known suitable carbon blacks not specifically disclosed herein may be selected as the filler or conductive component for the intermediate transfer members disclosed herein.

Examples of polyaniline fillers that can be selected for incorporation into the intermediate transfer members are PANIPOL™ F, commercially available from Panipol Oy, Finland; and known lignosulfonic acid grafted polyanilines. These polyanilines usually have a relatively small particle size diameter of, for example, from about 0.5 to about 5 microns; from about 1.1 to about 2.3 microns, or from about 1.5 to about 1.9 microns.

Metal oxide fillers that can be selected for the disclosed intermediate transfer members include, for example, tin oxide, antimony doped tin oxide, antimony dioxide, titanium dioxide, indium oxide, zinc oxide, indium-doped tin trioxide, indium tin oxide, and titanium oxide.

Suitable antimony doped tin oxides include those antimony doped tin oxides coated on an inert core particle (e.g., ZELEC® ECP-S, M and T), and those antimony doped tin oxides without a core particle (e.g., ZELEC® ECP-3005-XC and ZELEC® ECP-3010-XC; ZELEC® is a trademark of DuPont Chemicals, Jackson Laboratories, Deepwater, N.J.). The core particle may be mica, $TiO_2$ or acicular particles having a hollow or a solid core.

The antimony doped tin oxide particles can be prepared by densely layering a thin layer of antimony doped tin oxide onto the surface of a silica shell or silica-based particle, wherein the shell, in turn, has been deposited onto a core particle. The crystallites of the conductor are dispersed in such a fashion so as to form a dense conductive surface on the silica layer. This provides optimal conductivity. Also, the particles are fine enough in size to provide adequate transparency. The silica may either be a hollow shell or layered on the surface of an inert core, forming a solid structure. Forms of antimony doped tin oxide are commercially available under the tradename ZELEC® ECP (electroconductive powders) from DuPont Chemicals Jackson Laboratories, Deepwater, N.J. Particularly preferred antimony doped tin oxides are ZELEC® ECP 1610-S, ZELEC® ECP 2610-S, ZELEC® ECP 3610-S, ZELEC® ECP 1703-S, ZELEC® ECP 2703-S, ZELEC® ECP 1410-M, ZELEC® ECP 3005-XC, ZELEC® ECP 3010-XC, ZELEC® ECP 1410-T, ZELEC® ECP 3410-T, ZELEC® ECP-S-X1, and the like. Three commercial grades of ZELEC® ECP powders are preferred and include an acicular, hollow shell product (ZELEC® ECP-S), an equiaxial titanium dioxide core product (ZELEC® ECP-T), and a plate shaped mica core product (ZELEC® ECP-M).

When present, the filler can be selected in an amount of, for example, from about 0.1 to about 50 weight percent, from about 1 to about 60 weight percent, from about 1 to about 40 weight percent, from about 3 to about 40 weight percent, from about 4 to about 30 weight percent, from about 10 to about 30 percent, from about 10 to about 20 weight percent, from about 5 to about 30 weight percent, from about 15 to about 20 weight percent or from about 5 to about 20 weight percent based on the total of the solid ingredients in which the filler is included.

Optional Additional Polymers

In embodiments of the present disclosure, the intermediate transfer member containing polyarylatecarbonates layer can further include an optional polymer that primarily functions as a binder. Examples of suitable additional polymers include a polyamideimide, a polyimide, a polyetherimide, a polycarbonate, a polyphenylene sulfide, a polyamide, a polysulfone, a polyetherimide, a polyester, a polyvinylidene fluoride, a polyethylene-co-polytetrafluoroethylene, and the like, and mixtures thereof.

When an additional polymer is selected, it can be included in the intermediate transfer member in any desirable and effective amounts. For example, the additional polymer can be present in an amount of from about 1 to about 75 weight percent, from about 2 to about 45 weight percent, or from about 3 to about 15 weight percent, based on a total of the ingredients.

Optional Supporting Substrates

If desired, a supporting substrate can be included in the intermediate transfer member, such as beneath the polymer layer. The supporting substrate can be included to provide increased rigidity or strength to the intermediate transfer member.

The coating dispersion of the polyarylatecarbonate can be coated on any suitable supporting substrate material to form a dual layer intermediate transfer member. Exemplary supporting substrate materials include polyimides, polyamideimides, polyetherimides, mixtures thereof, and the like.

More specifically, examples of the intermediate transfer member supporting substrates are polyimides inclusive of known low temperature, and rapidly cured polyimide polymers, such as VTEC™ PI 1388, 080-051, 851, 302, 203, 201, and PETI-5, all available from Richard Blaine International, Incorporated, Reading, Pa., polyamideimides, polyetherimides, and the like. The thermosetting polyimides can be cured at temperatures of from about 180 to about 260° C. over a short period of time, such as from about 10 to about 120 minutes, or from about 20 to about 60 minutes, and generally have a number average molecular weight of from about 5,000 to about 500,000 or from about 10,000 to about 100,000, and a weight average molecular weight of from about 50,000 to about 5,000,000 or from about 100,000 to about 1,000,000. Also, for the supporting substrate there can be selected thermosetting polyimides that can be cured at temperatures of above 300° C., such as PYRE M.L.® RC-5019, RC 5057, RC-5069, RC-5097, RC-5053, and RK-692, all commercially available from Industrial Summit Technology Corporation, Parlin, N.J.; RP-46 and RP-50, both commercially available from Unitech LLC, Hampton, Va.; DURIMIDE® 100, commercially available from FUJIFILM Electronic Materials U.S.A., Inc., North Kingstown, R.I.; and KAPTON® HN, VN and FN, all commercially available from E.I. DuPont, Wilmington, Del.

Examples of polyamideimides that can be selected as supporting substrates for the intermediate transfer members disclosed herein are VYLOMAX® HR-11NN (15 weight percent solution in N-methylpyrrolidone, $T_g$=300° C., and $M_w$=45,000), HR-12N2 (30 weight percent solution in N-methylpyrrolidone/xylene/methyl ethyl ketone=50/35/15, $T_g$=255° C., and $M_w$=8,000), HR-13NX (30 weight percent solution in N-methylpyrrolidone/xylene=67/33, $T_g$=280° C., and $M_w$=10,000), HR-15ET (25 weight percent solution in ethanol/toluene=50/50, $T_g$=260° C., and $M_w$=10,000), HR-16NN (14 weight percent solution in N-methylpyrrolidone, $T_g$=320° C., and $M_w$=100,000), all commercially available from Toyobo Company of Japan, and TORLON® AI-10 ($T_g$=272° C.), commercially available from Solvay Advanced Polymers, LLC, Alpharetta, Ga.

Specific examples of polyetherimide supporting substrates that can be selected for the intermediate transfer members disclosed herein are ULTEM® 1000 ($T_g$=210° C.), 1010 ($T_g$=217° C.), 1100 ($T_g$=217° C.), 1285, 2100 ($T_g$=217° C.), 2200 ($T_g$=217° C.), 2210 ($T_g$=217° C.), 2212 ($T_g$=217° C.), 2300 ($T_g$=217° C.), 2310 ($T_g$=217° C.), 2312 ($T_g$=217° C.), 2313 ($T_g$=217° C.), 2400 ($T_g$=217° C.), 2410 ($T_g$=217° C.), 3451 ($T_g$=217° C.), 3452 ($T_g$=217° C.), 4000 ($T_g$=217° C.), 4001 ($T_g$=217° C.), 4002 ($T_g$=217° C.), 4211 ($T_g$=217° C.), 8015, 9011 ($T_g$=217° C.), 9075, and 9076, all commercially available from Sabic Innovative Plastics.

Once formed, the supporting substrate can have any desired and suitable thickness. For example, the supporting substrate can have a thickness of from about 10 to about 300 microns, such as from about 50 to about 150 microns, from about 75 to about 125 microns, from about 80 to about 105 microns, or from about 80 to about 90 microns.

Optional Release Layer

When desired, an optional release layer can be included in the intermediate transfer member, such as in the configuration of a layer over the polymer layer. The release layer can be included to assist in providing toner cleaning and additional developed image transfer efficiency from a photoconductor to the intermediate transfer member.

When selected, the release layer can have any desired and suitable thickness. For example, the release layer can have a thickness of from about 1 to about 100 microns, about 10 to about 75 microns, or from about 20 to about 50 microns.

The optional release layer can comprise TEFLON®-like materials including fluorinated ethylene propylene copolymer (FEP), polytetrafluoroethylene (PTFE), polyfluoroalkoxy polytetrafluoroethylene (PFA TEFLON®), and other TEFLON®-like materials; silicone materials, such as fluorosilicones and silicone rubbers, such as Silicone Rubber 552, available from Sampson Coatings, Richmond, Va., (polydimethyl siloxane/dibutyl tin diacetate, 0.45 gram DBTDA per 100 grams polydimethyl siloxane rubber mixture, with a molecular weight $M_w$ of approximately 3,500); and fluoroelastomers, such as those sold as VITON®, such as copolymers and terpolymers of vinylidenefluoride, hexafluoropropylene, and tetrafluoroethylene, which are known commercially under various designations as VITON A®, VITON E®, VITON E60C®, VITON E45®, VITON E430®, VITON B910®, VITON GH®, VITON B50®, and VITON GF®. The VITON® designation is a Trademark of E.I. DuPont de Nemours, Inc. Two known fluoroelastomers are comprised of (1) a class of copolymers of vinylidenefluoride, hexafluoropropylene, and tetrafluoroethylene, known commercially as VITON A®; (2) a class of terpolymers of vinylidenefluoride, hexafluoropropylene, and tetrafluoroethylene, known commercially as VITON B®; and (3) a class of tetrapolymers of vinylidenefluoride, hexafluoropropylene, tetrafluoroethylene, and a cure site monomer, such as VITON GF®, having 35 mole percent of vinylidenefluoride, 34 mole percent of hexafluoropropylene, and 29 mole percent of tetrafluoroethylene with 2 percent cure site monomer. The cure site monomers can be those available from E.I. DuPont de Nemours, Inc. such as 4-bromoperfluorobutene-1,1,1-dihydro-4-bromoperfluorobutene-1,3-bromoperfluoropropene-1,1,1-dihydro-3-bromoperfluoropropene-1, or any other suitable, known, commercially available cure site monomers.

Intermediate Transfer Member Formation

The polyarylatecarbonate intermediate transfer members, or the mixtures thereof as illustrated herein comprising a polyarylatecarbonate, an optional second polymer like a polycarbonate, an optional polysiloxane, and an optional conductive filler component, can be formulated into an intermediate transfer member by any suitable method. For example, with known milling processes, uniform dispersions of the polyarylatecarbonates, or the intermediate transfer member mixtures can be obtained, and then coated on individual metal substrates, such as a stainless steel substrate or the like, using known draw bar coating or flow coating methods. The resulting individual film or films can be dried by heating at, for example, from about 100 to about 400° C., from about 160 to about 320° C., from about 125 to about 190° C., at from about 120° C. for a suitable period of time, such as from about 20 to about 180 minutes, from about 40 to about 120 minutes, or from about 25 to about 35 minutes while remaining on the substrates.

After drying and cooling to room temperature, about 23 to about 25° C., the films readily release from the steel substrates. That is, the films obtained immediately release, such as for example within from about 1 to about 15 seconds, from about 1 to about 10 seconds, from about 5 to about 15 seconds, from about 5 to about 10 seconds, or about 1 second without any external assistance. The resultant intermediate transfer film product can have a thickness of, for example, from about 30 to about 400 microns, from about 15 to about 150 microns, from about 20 to about 100 microns, from about 50 to about 200 microns, from about 70 to about 150 microns, or from about 25 to about 75 microns.

As metal substrates selected for the deposition of the mixture disclosed herein, there can be selected stainless steel, aluminum, nickel, copper, and their alloys, glass plates, and other conventional typical known materials.

Examples of solvents selected for formation of the intermediate transfer member mixtures, which solvents can be selected in an amount of, for example, from about 60 to about 95 weight percent, or from about 70 to about 90 weight percent of the total mixture ingredients, include alkylene halides, such as methylene chloride, tetrahydrofuran, toluene, monochlorobenzene, N-methyl-2-pyrrolidone, N,N-dimethylformamide, N,N-dimethylacetamide, methyl ethyl ketone, dimethylsulfoxide (DMSO), methyl isobutyl ketone, formamide, acetone, ethyl acetate, cyclohexanone, acetanilide, mixtures thereof, and the like. Diluents can be mixed with the solvents selected for the intermediate transfer member mixtures. Examples of diluents added to the solvents in amounts of from about 1 to about 25 weight percent, and from 1 to about 10 weight percent based on the weight of the solvent, and the diluent are known diluents like aromatic hydrocarbons such as benzene, and the like.

The intermediate transfer members illustrated herein can be selected for a number of printing and copying systems, inclusive of xerographic printing systems. For example, the disclosed intermediate transfer members can be incorporated into a multi-imaging xerographic machine where each developed toner image to be transferred is formed on the imaging or photoconductive drum at an image forming station, and where each of these images is then developed at a developing station, and transferred to the intermediate transfer member. The images may be formed on a photoconductor and developed sequentially, and then transferred to the intermediate transfer member. In an alternative method, each image may be formed on the photoconductor or photoreceptor drum, developed, and then transferred in registration to the intermediate transfer member. In an embodiment, the multi-image system is a color copying system, wherein each color of an image being copied is formed on the photoreceptor drum, developed, and transferred to the intermediate transfer member.

After the toner latent image has been transferred from the photoreceptor drum to the intermediate transfer member, the intermediate transfer member may be contacted under heat and pressure with an image receiving substrate such as paper. The toner image on the intermediate transfer member is then transferred and fixed, in image configuration, to the substrate such as paper.

In an image on image transfer, the color toner images are first deposited on the photoreceptor and all the color toner images are then transferred simultaneously to the intermediate transfer member disclosed herein. In a tandem transfer, the toner image is transferred one color at a time from the photoreceptor to the same area of the intermediate transfer member illustrated herein.

Specific embodiments will now be described in detail. These examples are intended to be illustrative, and are not limited to the materials, conditions, or process parameters set forth in these embodiments. All parts are percentages by weight of total solids of all the components unless otherwise indicated.

COMPARATIVE EXAMPLE 1

A coating composition was prepared by stirring a mixture of special carbon black 4 obtained from Degussa Chemicals, a polycarbonate PCZ-400 [poly(4,4'-dihydroxy-diphenyl-1-1-cyclohexane, $M_w$=40,000)], available from Mitsubishi Gas Chemical Company, and which polycarbonate is soluble in monochlorobenzene, and as a leveling agent the polyester modified polydimethylsiloxane, available as BYK® 333 from BYK Chemical, in a ratio of polycarbonate/carbon black/polyester modified polydimethylsiloxane, of 89.99/10/0.01 based on the initial mixture feed amounts, in monochlorobenzene about 15 weight solids. The obtained intermediate transfer member dispersion was coated on a stainless steel substrate of a thickness of 0.5 millimeter, and subsequently the mixture was dried at 160° C. for 40 minutes. The resulting intermediate transfer member of a thickness of 50 microns comprised of the above components in weight percent ratio of polycarbonate PCZ-400/carbon black/polyester modified polydimethylsiloxane BYK® 333 of 89.99/10/0.01 readily released from the stainless steel substrate in 10 seconds without the assistance of any external processes.

COMPARATIVE EXAMPLE 2

A coating composition was prepared by stirring a mixture of special carbon black 4 obtained from Evonik-Degussa Chemicals, a polyimide generated from polyamic acid of pyromellitic dianhydride/4,4'-oxydianiline (PYRE® MC RC-5019) available from Industrial Summit Technology Inc., and which polyamic acid is soluble in N-methylpyrrolidone (NMP), and as a leveling agent the polyester modified polydimethylsiloxane, available as BYK® 333 from BYK Chemical, in a ratio of polyamic acid/carbon black/polyester modified polydimethylsiloxane, of 89.99/10/0.01 based on the initial mixture feed amounts in N-methylpyrrolidone about 15 weight solids. The obtained intermediate transfer member dispersion was coated on a stainless steel substrate of a thickness of 0.5 millimeter, and subsequently the mixture was dried at 190° C. for 45 minutes and 290° C. for 60 minutes. The resulting intermediate transfer member of a thickness of 50 microns comprised of the above components in the ratio of 89.99/10/0.01 polyamic acid/carbon black/polyester modified polydimethylsiloxane did not release from the stainless steel substrate, but rather adhered to this substrate. After being immersed in water for 3 months, the intermediate transfer member film obtained eventually self-released from the substrate.

EXAMPLE I

There was prepared by admixing with stirring and milling a coating composition comprising special carbon black 4, obtained from Evonik-Degussa Chemical, a copolymer of a polyarylatecarbonate of the following formula/structure as obtained from Mitsubishi Gas Chemical Company, Inc., as PAC-Z80BP20, and primarily for surface smoothness a copolymer of a polyester and a polydimethylsiloxane BYK® 333, which copolymer was obtained from BYK Chemical, in a ratio of the polyarylatecarbonate copolymer/carbon black/siloxane copolymer of 89.99/10/0.01, based on the initial mixture feed amounts in monochlorobenzene about 15 weight solids.

The obtained intermediate transfer member dispersion was then coated on a stainless steel substrate of a thickness of 0.5 millimeter, and subsequently the mixture resulting was dried by heating at 120° C. for 40 minutes. The resulting intermediate transfer member, 50 microns in thickness, with a flat configuration, and with no curl comprised of the above ingredients of the polyarylatecarbonate copolymer/carbon black/polyester modified polydimethylsiloxane BYK® 333 in a ratio of 89.99/10/0.01 readily released from the stainless steel substrate in 10 seconds without the assistance of any external processes.

The formula/structure of the above polyarylatecarbonate copolymer is as follows

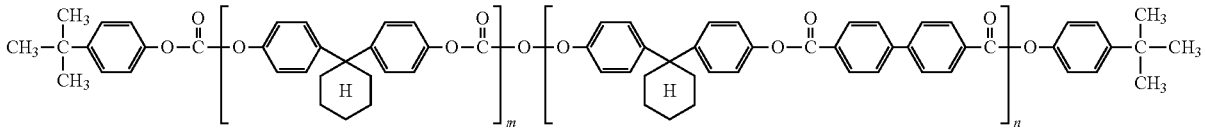

wherein m is 80 mol percent, n is 20 mol percent, and the total thereof is 100 mol percent, and the viscosity average molecular weight is 46,600, and which viscosity average molecular weight was provided by Mitsubishi Gas Chemical Company, Inc.

EXAMPLE II

Intermediate transfer members are prepared by repeating the process of Example I except there is selected as the polyarylatecarbonate copolymer those of the following formulas/structures, each obtainable from Mitsubishi Gas Chemical Company, Inc., wherein m is 80 mol percent, n is 20 mol percent, and the total thereof is 100 mol percent, and the viscosity average molecular weights being 57,200 and 62,600, respectively, as provided by Mitsubishi Gas Chemical Company, Inc.,

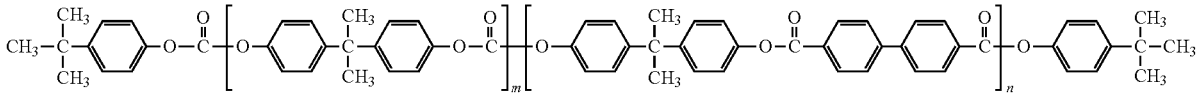

PAC-A80BP20 and

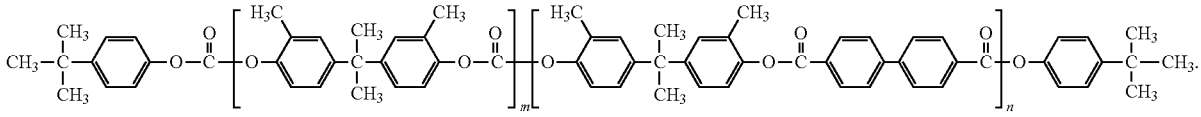

PAC-C80BP20

MEASUREMENTS

The above intermediate transfer members of Example I and the Comparative Example 1 and Comparative Example 2 were measured for Young's Modulus following the known ASTM D882-97 process. Samples (0.5 inch×12 inch) of each intermediate transfer member were placed in a Instron Tensile Tester measurement apparatus, and then the samples were elongated at a constant pull rate until breaking. During this time, there was recorded the resulting load versus the sample elongation. The Young's Modulus was calculated by taking any point tangential to the initial linear portion of the recorded curve results and dividing the tensile stress by the corresponding strain. The tensile stress was calculated by dividing the load by the average cross sectional area of each of the test samples. The results are provided in the following Table.

The intermediate transfer members of Example I, Comparative Example 1, and Comparative Example 2 were further tested for their thermal expansion coefficients (CTE) using a Thermo-mechanical Analyzer (TMA). The intermediate transfer member samples were cut using a razor blade and a metal die to 4 millimeter wide pieces which were then mounted between the TMA clamp using a measured 8 millimeter spacing. The samples were preloaded to a force of 0.05 Newton (N). Data was analyzed from the $2^{nd}$ heat cycle. The CTE value was obtained as a linear fit through the data between the temperature points of interest of from about a −20 to about 50° C. regions using the TMA software, and the results are provided in the following Table.

The surface resistivity of the above intermediate transfer members (ITM) of Example I, Comparative Example 1, and Comparative Example 2 were measured using a High Resistivity Meter, and the results are provided in the following Table.

TABLE

| | Surface Resistivity (log ohm/sq) | Young's Modulus (MPa) | CTE (ppm/K) | Release From Metal Substrate |
|---|---|---|---|---|
| Example I Polyarylatecarbonate Intermediate Transfer Member | 9.8 | 2,700 | 86 | Self-Released in 10 Seconds |
| Comparative Example 1 Polycarbonate Z Intermediate Transfer Member | 10.6 | 1,600 | 150 | Self-Released In 10 Seconds |
| Comparative Example 2 Polyimide Intermediate Transfer Member | 10.4 | 3,500 | 69 | Did Not Release Without a Release agent and Until After Being Placed in Water for 3 Months |

The disclosed polyarylatecarbonate copolymer containing intermediate transfer member of Example I possessed an about 70 percent higher Young's Modulus and about 40 percent lower CTE value, evidencing excellent mechanical properties and thus an extended lifetime for this member versus the Comparative Example 1 thermoplastic polycarbonate intermediate transfer member. A 70 percent higher modulus for the Example I intermediate transfer member indicates that this member has less of tendency to break apart when selected for a xerographic printing process, especially as this is applicable to high speed printing processes exceeding about 120 copies per minute. A 40 percent lower CTE for the Example I intermediate transfer member indicates that this member has a more accurate color registration of about 45 percent when operating at relatively higher temperatures such as about 50° C.

Additionally, the disclosed polyarylatecarbonate copolymer thermoplastic intermediate transfer member of Example I possessed excellent release characteristics in that this member readily self-released from the stainless steel substrate in 10 seconds, whereas the Comparative Example 2 thermoset polyimide containing intermediate transfer member did not release from the stainless steel substrate, but rather adhered to this substrate, and only after being immersed in water for 3 months did this intermediate transfer member film eventually self-release from the substrate.

Further, the intermediate transfer member of Example I can be prepared at about a 50 percent less material cost in that the polyarylatecarbonate is 50 percent less costly than the polyimide of Comparative Example 2 and a 65 percent lower manufacturing cost than the intermediate transfer member of Comparative Example 1 primarily because the drying of the polyarylatecarbonate intermediate transfer member requires a lower temperatures, about 120° C. for a shorter time, about 40 minutes, whereas the drying of the Comparative Example 2 intermediate transfer member requires higher temperatures, about 300° C., and an extended longer drying time of about 2 hours.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An intermediate transfer member comprising a polyarylatecarbonate, wherein said polyarylatecarbonate is a copolymer selected from the group consisting of those represented by the following formulas/structures

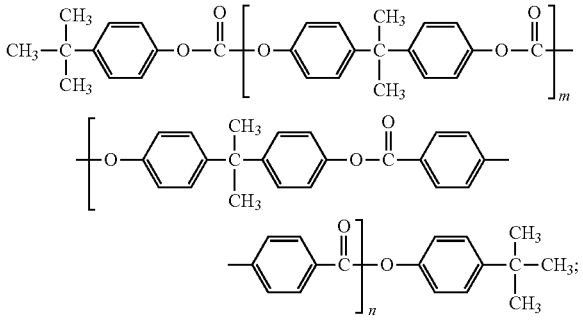

-continued

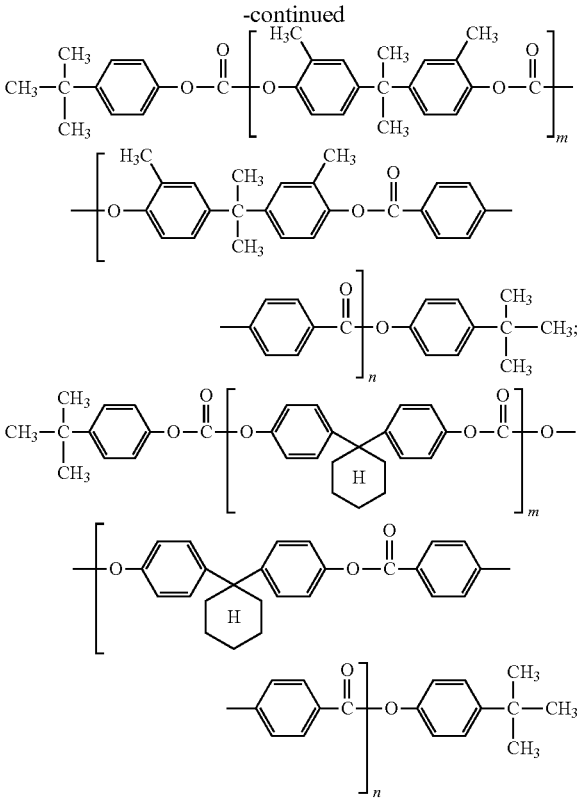

and mixtures thereof, wherein m is from about 60 to about 90 mol percent, and n is from about 10 to about 40 mol percent, and wherein the total thereof is about 100 mol percent.

2. An intermediate transfer member in accordance with claim 1 comprising a mixture of ingredients comprised of said polyarylatecarbonate, a polysiloxane, and a conductive filler component.

3. An intermediate transfer member in accordance with claim 2 wherein m is from about 65 to about 85 mol percent, and n is from about 15 to about 35 mol percent.

4. An intermediate transfer member in accordance with claim 2 wherein said polyarylatecarbonate is represented by the following formula/structure

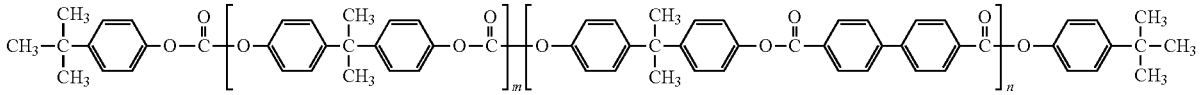

wherein m is from about 75 to about 85 mole percent, and n is from about 15 to about 25 mol percent.

5. An intermediate transfer member in accordance with claim 2 wherein said polyarylatecarbonate is represented by the following formula/structure

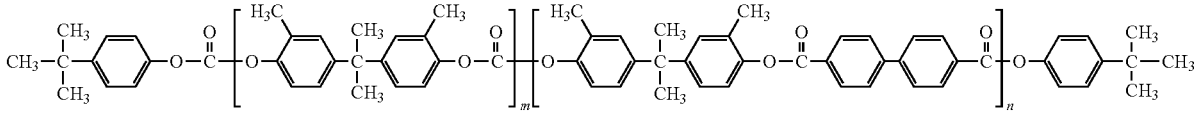

wherein m is from about 75 to about 85 mole percent, and n is from about 15 to about 25 mol percent.

6. An intermediate transfer member accordance with claim 2 wherein said polyarylatecarbonate is represented by the following formula/structure

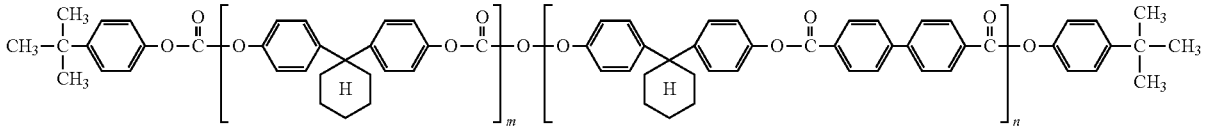

wherein m is from about 75 to about 85 mole percent, and n is from about 15 to about 25 mol percent.

7. An intermediate transfer member in accordance with claim 2 wherein said polyarylatecarbonate is present in an amount of from about 65 to about 95 weight percent; said filler is carbon black present in an amount of from about 5 to about 30 weight percent, and said polysiloxane is present in an amount of from about 0.01 to about 10 weight percent of solids.

8. An intermediate transfer member in accordance with claim 2 wherein said polyarylatecarbonate is present in an amount of from about 70 to about 90 weight percent of solids, said filler is carbon black present in an amount of from about 10 to about 25 weight percent, and said polysiloxane is present in an amount of from about 0.1 to about 3 weight percent of solids, and said polyarylatecarbonate has a weight average molecular weight of from about 40,000 to about 70,000, and a number average molecular weight of from about 30,000 to about 60,000 as determined by GPC analysis.

9. An intermediate transfer member in accordance with claim 2 wherein for each ingredient of the mixture the polyarylatecarbonate is present in an amount of from about 75 to about 85 weight percent, the polysiloxane is present in an amount of from about 0.2 to about 0.5 weight percent, and the conductive filler component is present in an amount of from about 15 to about 20 weight percent, with the total of ingredients being about 100 percent.

10. An intermediate transfer member in accordance with claim 2 wherein the ratio of said polyarylatecarbonate/said filler/said polysiloxane is about 95/4/1, 90/9.99/0.01, 90/9.95/.0.05, 89.99/10/0.01, 80/19.8/0.2, or 85/12/3.

11. An intermediate transfer member in accordance with claim 2 wherein said conductive filler is a metal oxide, a polyaniline, or carbon black.

12. An intermediate transfer member in accordance with claim 2 further including in contact with said mixture a release layer comprising at least one ingredient selected from the group consisting of a fluorinated ethylene propylene copolymer, a polytetrafluoroethylene, a polyfluoroalkoxy polytetrafluoroethylene, a fluorosilicone, a terpolymer of vinylidene fluoride, hexafluoropropylene, and tetrafluoroethylene, and mixtures thereof; and wherein said polysiloxane is a copolymer of a polyether and a polydimethylsiloxane, a copolymer of a polyester and a polydimethylsiloxane, a copolymer of a polyacrylate and a polydimethylsiloxane, or a copolymer of a polyester polyether and a polydimethylsiloxane.

13. An intermediate transfer member in accordance with claim 2 wherein said member self-releases from a supporting substrate of a metal subsequent to being deposited on said metal, and which self-release is accomplished in from about 1 to about 10 seconds, and wherein the Young's Modulus of said member is from about 2,500 to 3,500 MPa.

14. An intermediate transfer member comprised of a supporting substrate, and thereover a layer comprised of a mixture of a polyarylatecarbonate, a conductive component, and a polysiloxane wherein said polyarylatecarbonate is selected from the group consisting of those represented by the following formulas/structures

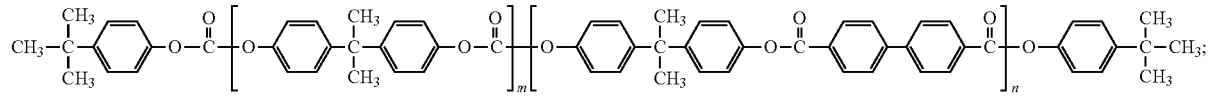

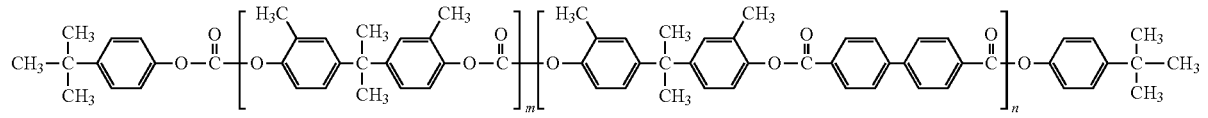

and

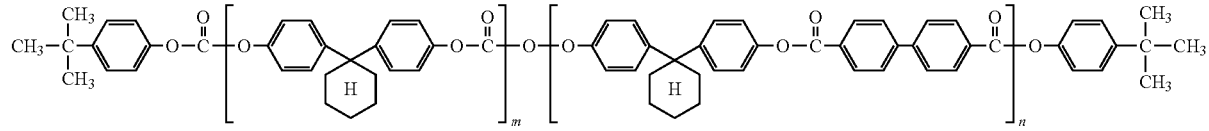

wherein m is from about 60 to about 90 mol percent, and n is from about 10 to about 40 mol percent, and wherein the total thereof is about 100 mol percent.

15. An intermediate transfer member in accordance with claim 14 wherein said polyarylatecarbonate is

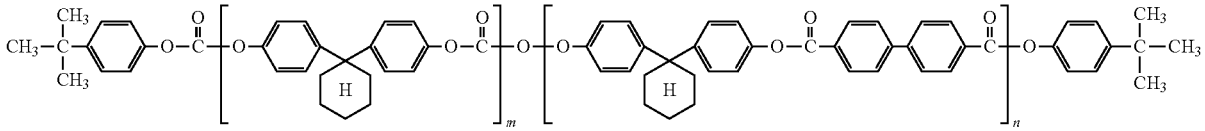

wherein m is from about 75 to about 85 mol percent, and n is from about 15 to about 25 mol percent.

16. An intermediate transfer member in accordance with claim 15 wherein said member self-releases from a supporting substrate of a metal subsequent to being deposited on said metal, and which self-release is accomplished in from about 1 to about 10 seconds, and wherein the Young's Modulus of said member is from about 2,400 to 3,000 MPa.

17. An intermediate transfer member comprised of said member and a photoconductor, and where a developed toner image is transferred from said photoconductor to said intermediate transfer member, and which member is comprised of an optional supporting substrate, and thereover a layer mixture of carbon black, a polysiloxane, and a polyarylatecarbonate of

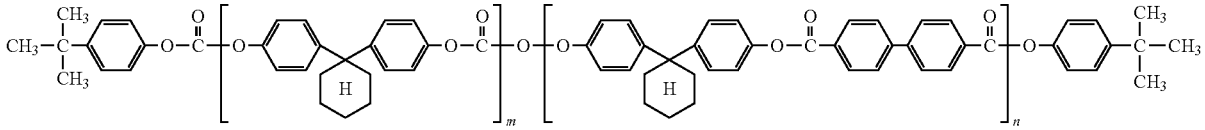

wherein m is from about 75 to about 85 mol percent, and n is from about 15 to about 25 mol percent.

18. An intermediate transfer member in accordance with claim 17 with a Young's Modulus of from about 2,600 to 3,200 MPa; said m is about 80 mol percent; said n is about 20 mol percent, and which layer mixture is readily releasable from a metal substrate.

* * * * *